US005517716A

United States Patent [19]

Park

[11] Patent Number: 5,517,716

[45] Date of Patent: May 21, 1996

[54] VACUUM CLEANER HAVING SOUND DAMPENING SUCTION LEAD

[75] Inventor: Choul-Woo Park, Suwon, Rep. of Korea

[73] Assignee: Samsung Electronics Co., Ltd., Suwon, Rep. of Korea

[21] Appl. No.: 304,856

[22] Filed: Sep. 13, 1994

[30] Foreign Application Priority Data

Sep. 17, 1993 [KR] Rep. of Korea ..... 1993-18741

[51] Int. Cl.[6] ..... A47L 9/00; A47L 9/02

[52] U.S. Cl. ..... 15/326; 15/377

[58] Field of Search ..... 15/326, 377

[56] References Cited

U.S. PATENT DOCUMENTS 2,203,088 6/1940 Hansson ..... 15/326 X 3,204,282 9/1965 Groves et al. ..... 15/326 X 4,537,424 8/1985 Maier et al. ..... 15/377 X

FOREIGN PATENT DOCUMENTS 62-36690 8/1987 Japan .

418433 12/1994 Japan ..... 15/326

*Primary Examiner*—Chris K. Moore

*Attorney, Agent, or Firm*—Burns, Doane, Swecker & Mathis

[57] ABSTRACT

A vacuum cleaner includes a suction generator, a dust collector, a hose extending from the dust collector, and a suction head disposed at a free end of the hose. The suction head includes an air inlet and an air outlet, and noise dampening material disposed inside the suction head above the inlet and on opposite sides of the outlet.

17 Claims, 6 Drawing Sheets

FIG. 6
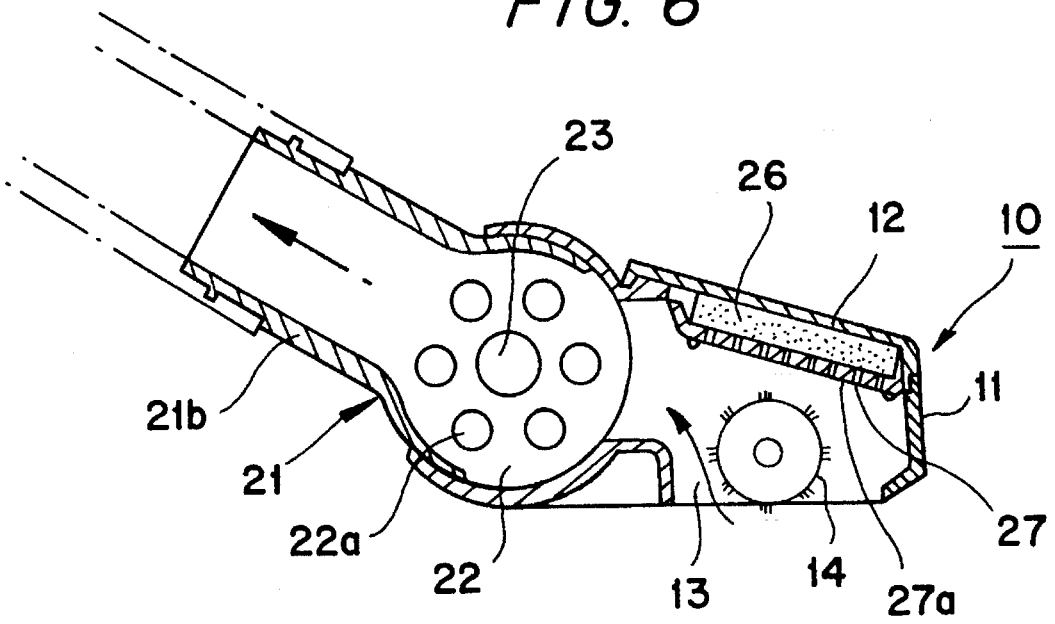
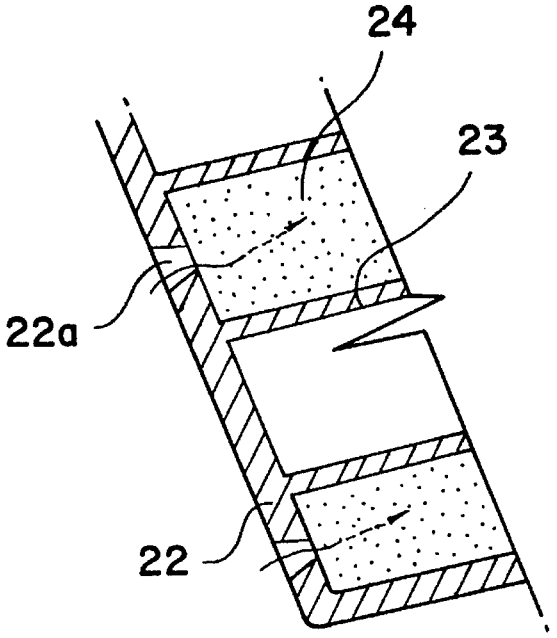
FIG. 7

VACUUM CLEANER HAVING SOUND DAMPENING SUCTION LEAD

BACKGROUND OF THE INVENTION

1. Field of the Invention

The present invention relates to a vacuum cleaner for absorbing foreign objects such as dust and/or the like by way of a suction force, and more particularly to a suction apparatus for reducing noise generated by driving motor and by airflow within a suction head or suction mouth piece body.

2. Description of the Prior Art

A conventional vacuum cleaner as a prior art, as illustrated in FIG. 1, is formed with: a driving means 2 for being disposed in a body 1 of the vacuum cleaner and for generating strong suction force; a dust collecting unit 3 for being disposed at an inlet side of the driving means for collecting foreign objects such as dust and/or the like by way of the suction force; a suction pipe 4; handle 5; and an extension pipe 6, in that order.

The extension pipe 6 is rotatably connected at one end thereof to a connecting pipe 7 at a predetermined angle, and a bottom end of the connecting pipe 7 is connected to a suction head or suction mouth piece body 8 for sucking up foreign objects such as the dust and/or the like by way of the suction force.

Accordingly, the foreign objects such as the dust and/or the like are sucked in by the operation of the driving means 2 through the suction mouth piece body 8, the connecting pipe 7, the extension pipe 6, the handle 5 and the suction pipe 4, to thereby be collected at the dust collecting unit 3 whereas purified air which has passed the dust collecting unit 3 is discharged to the atmosphere.

However, the driving means 2 and the suction mouth piece body 8 in the vacuum cleaner thus described are sources for generating the noise, which presents a serious problem calling for a solution.

A conventional vacuum cleaner disclosed to solve the aforementioned problems, as illustrated in FIG. 2, has a construction wherein a suction passage 8*a* is formed inside the suction mouth piece body 8 through which the dust and the air are sucked in and the connecting pipe 7 rotatable at a predetermined angle is connected to one side of the suction mouth piece body 8.

The vacuum cleaner described above therefore performs a cleaning job by sucking in the foreign objects such as dust and/or the like.

However, such the conventional vacuum cleaners have problems in that there arises considerable noise caused by air turbulence generated by the foreign objects and by the air converging at a narrow entrance of the connecting pipe 7, and the problems are aggravated further by subsequent propagation of the noise to the suction mouth piece body 8.

In other prior art as disclosed in FIG. 3 to solve the aforementioned problems, Japanese Publication No. 62-36690 discloses a vacuum cleaner wherein a noise reducing material 9 is inserted into an inner side of the extension pipe 6 and a reinforcement 9*a* is formed therewith to maintain shape of the material 9 therein, so that the noise generation can be reduced.

Although the structure disclosed in the Japanese application can reduce to some extent the noise generated from within the suction mouth piece body 8, the suppression of high-pitched noise generated from within the suction mouth piece body 8 is very insufficient, and there is a problem in that the noise generated from the driving means is also transferred to the suction mouth piece body.

Accordingly, it is an object of the present invention to provide a suction apparatus of a vacuum cleaner for absorbing noise generated by driving means as well as noise generated by the inflow of air into a suction mouthpiece body, so that a cleaning job can be done in a quiet and silent manner.

SUMMARY OF THE INVENTION

In order to overcome the aforementioned disadvantages, according to the present invention, there is provided a suction apparatus of the vacuum cleaner for absorbing the foreign objects such as dust and/or the like by way of suction force according to the driving means thereof, the apparatus comprising: a floor plate for being stuffed at both sides thereof with a first noise absorption material for absorbing the noise generated by the air being sucked into the suction mouth piece body; a connecting pipe for being stuffed at both sides thereof with a second noise absorption material for absorbing the noise generated by the air flowing into the floor plate; and a lid plate for being attached with a third noise absorption material thereunder for sucking the noise generated from the floor plate.

The suction apparatus of the vacuum cleaner thus constructed is characterized by elimination of the noises generated from the driving means and the noises generated in the course of absorption of the air by way of the first, second and third noise absorption materials formed at the upper, lower sides of the suction mouth piece body and both sides of the connecting pipe, thereby minimizing the generated noises and enabling a quiet and silent cleaning job.

BRIEF DESCRIPTION OF THE DRAWINGS

For a fuller understanding of the nature and objects of the invention, reference should be made to the following detailed description taken in conjunction with the accompanying drawings in which;

FIG. 6 is a vertical sectional view of the suction mouth piece body depicted in FIG. 5; and FIG. 7 is an enlarged sectional view of a noise absorbing arrangement in FIG. 5.

DETAILED DESCRIPTION OF A PREFERRED EMBODIMENT OF THE INVENTION

Figure 1:
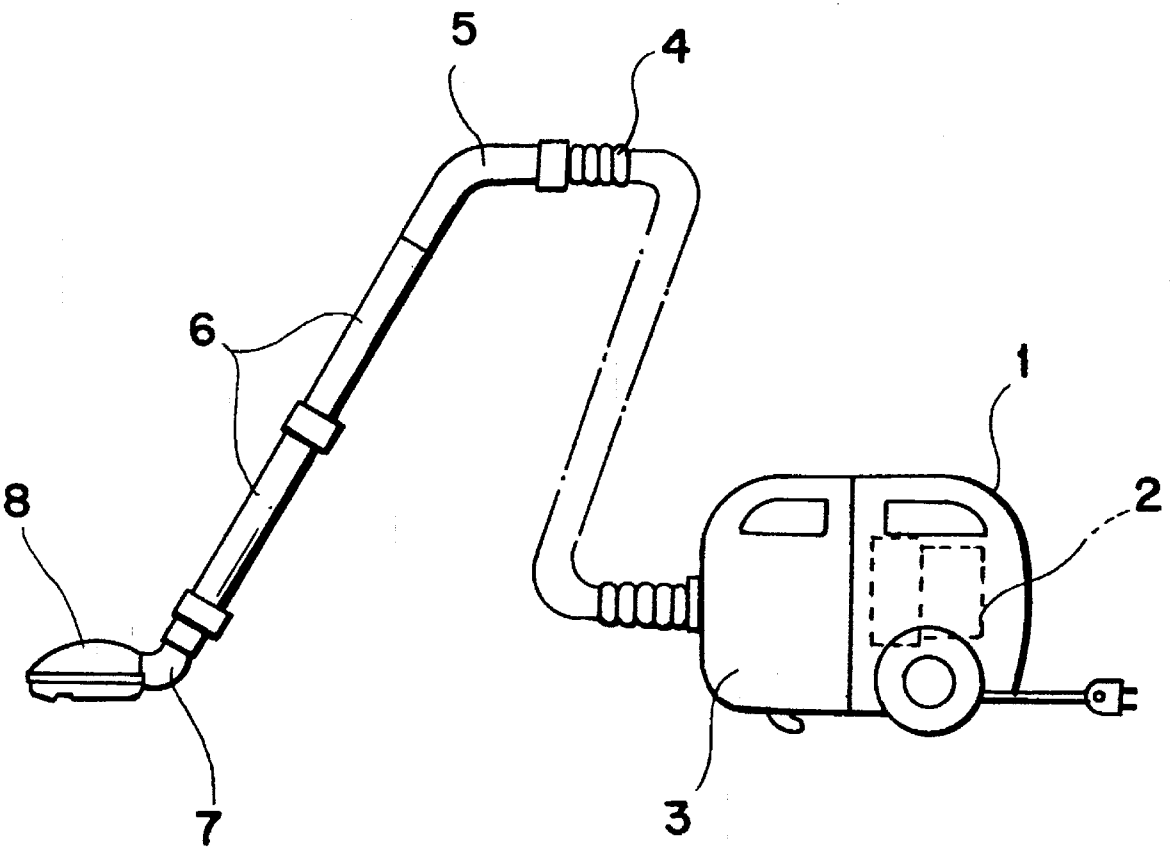
FIG. 1 (PRIOR ART)
FIG. 1 is a side elevational view of a conventional vacuum cleaner.
Figure 2:
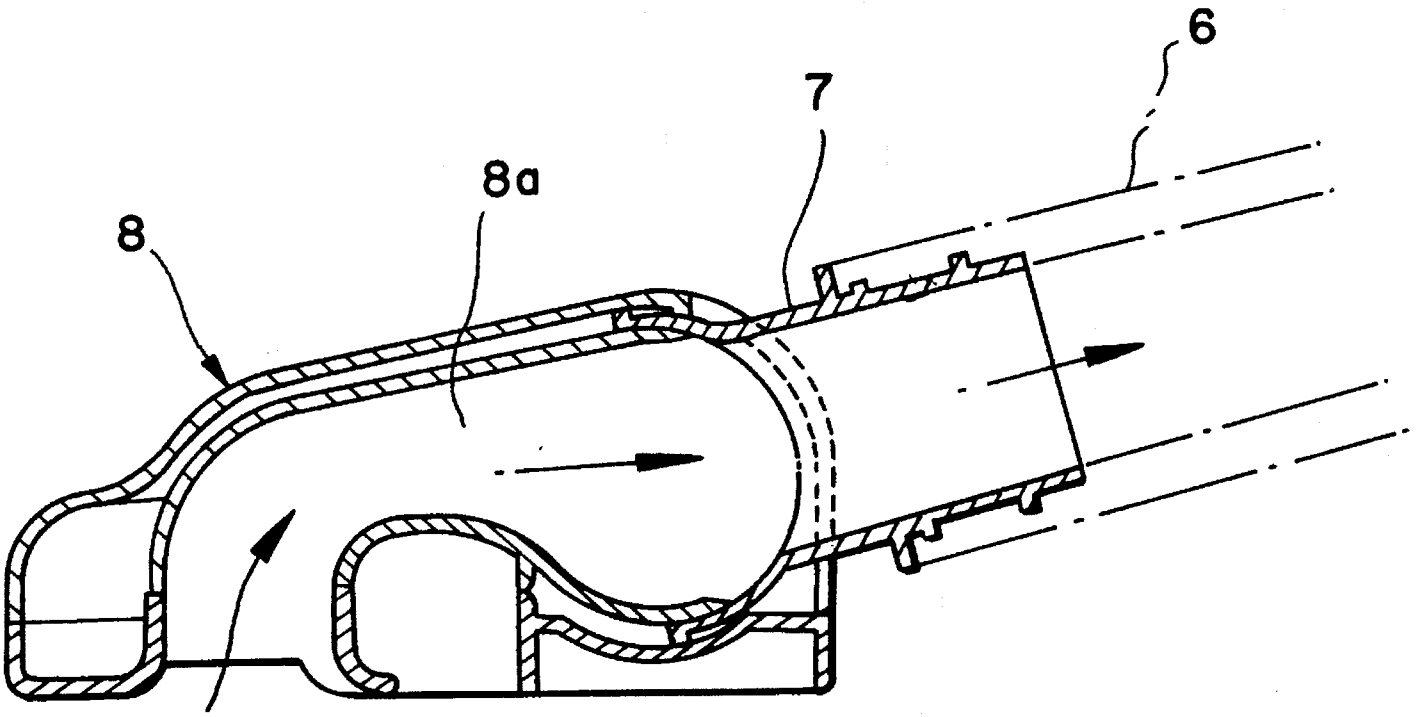
FIG. 2 (PRIOR ART)
FIG. 2 is a partial vertical sectional view of illustrating one embodiment of a conventional suction mouth piece body.
Figure 3:
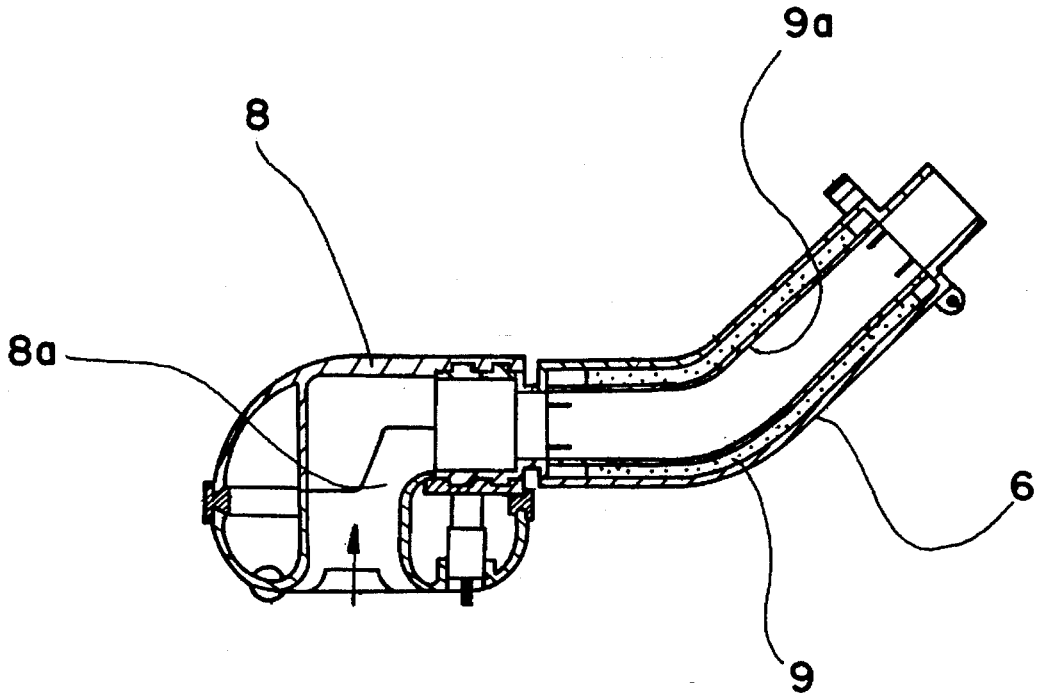
FIG. 3 (PRIOR ART)
FIG. 3 is a partial vertical sectional view of another embodiment of a conventional suction mouth piece body a conventional.
Figure 4:
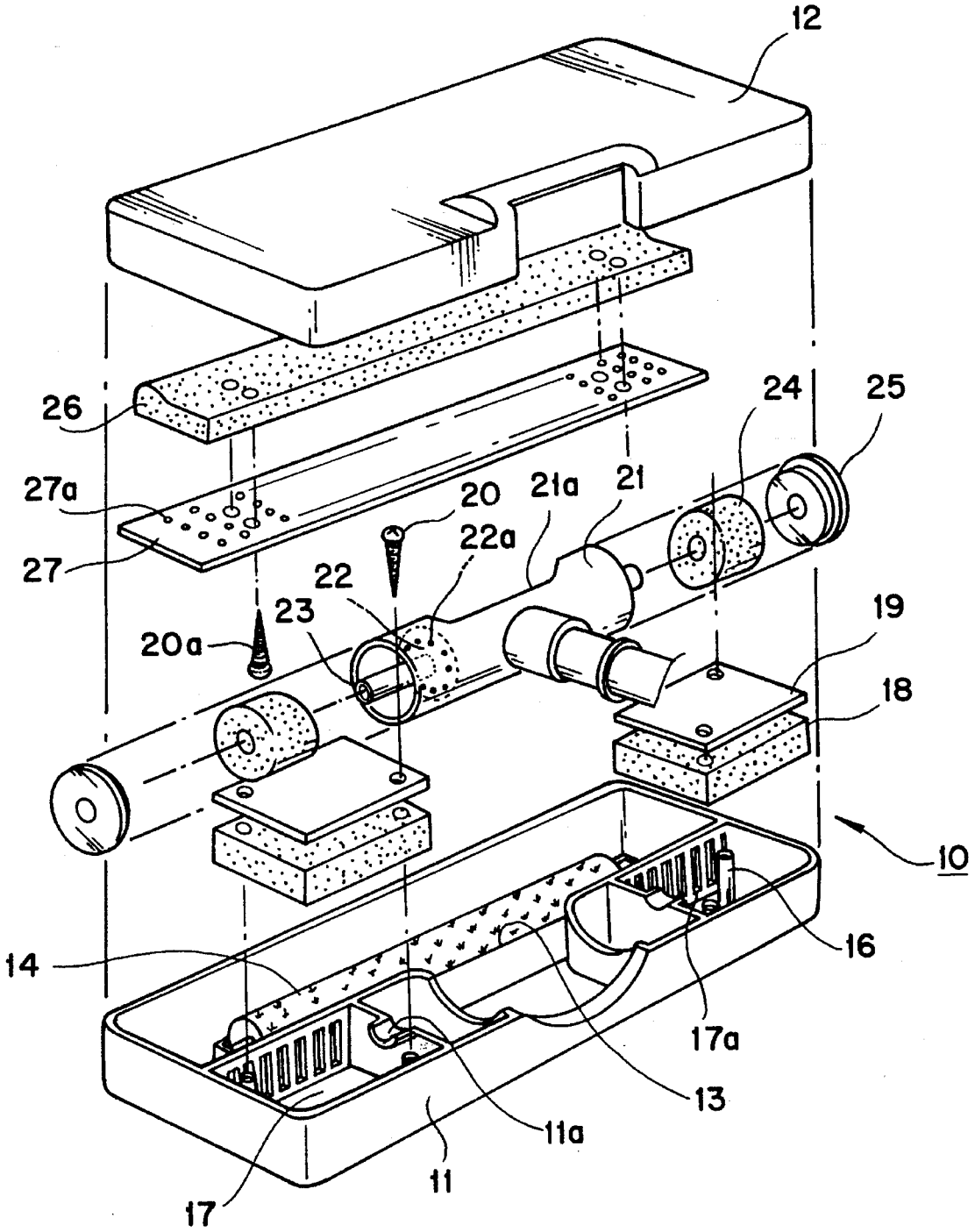
FIG. 4 is an exploded perspective view of a suction mouth piece body of a vacuum cleaner according to the present invention.
Figure 5:
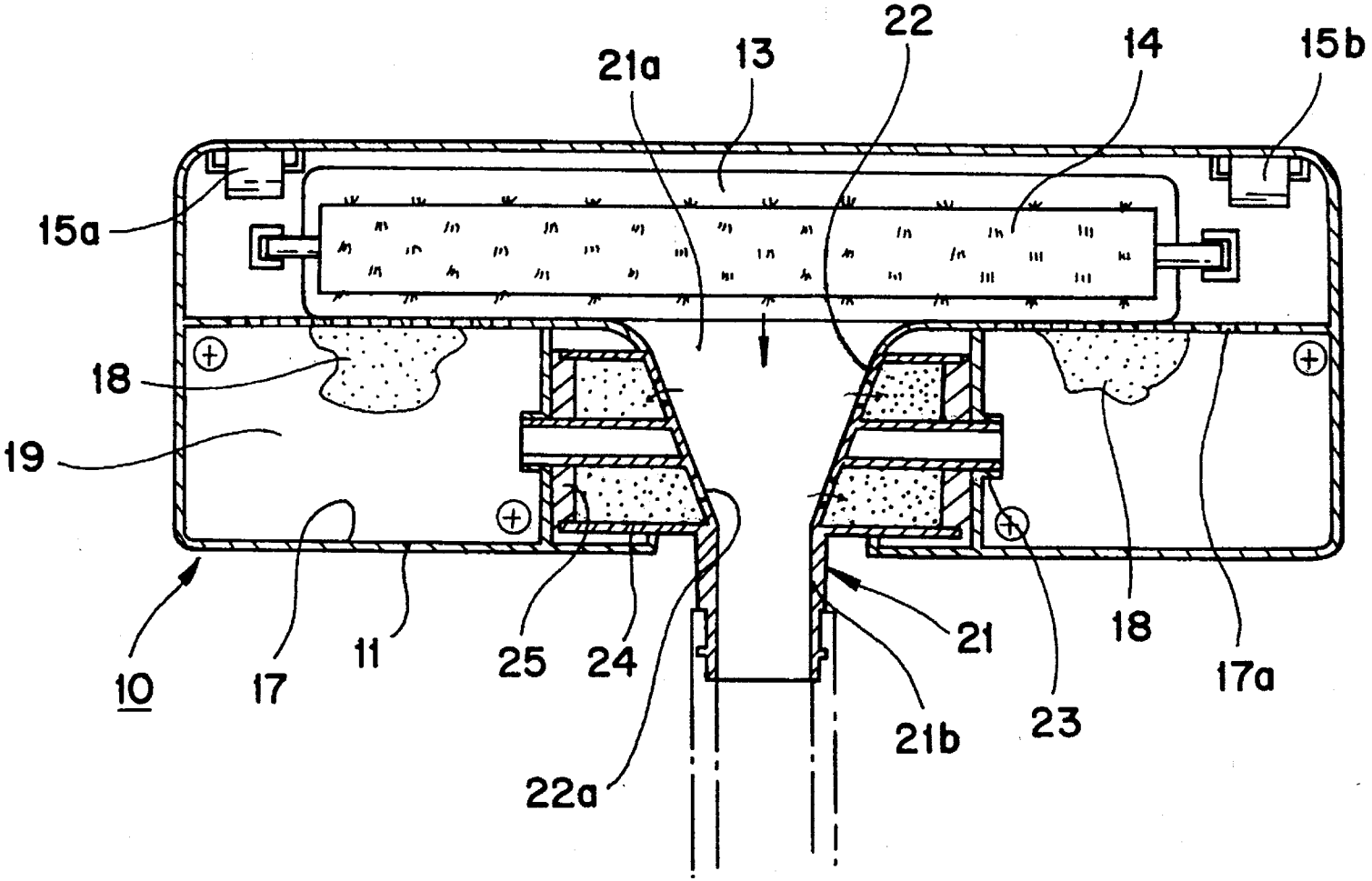
FIG. 5 is a horizontal sectional view of the suction mouth piece body depicted in FIG. 4.

Hereinafter, a preferred embodiment of the present invention will be described in detail with reference to the accompanying FIGS. 4, 5, 6 and 7.

Reference numeral 10 in the drawings is the suction, head or suction mouth piece body having a house comprised of a lid plate connected to an upper side of a floor plate 11.

The floor plate 11 is provided on a bottom surface thereof with a suction entrance 13 for absorbing the dust and the air, and the suction entrance 13 is provided with a rotary brush roller arranged 14 therewithin for drawing in foreign objects such as the dust in response to rotary movement thereof.

The floor plate 11 is rotatably coupled at both sides thereof with wheels 15*a* and 15*b* for easy travel of the vacuum cleaner during the cleaning job.

Furthermore, the floor plate 11 is protrudingly formed with a plurality of vertical bosses 16 at both sides thereof, and a pair of noise absorption chambers 17 are respectively formed around the bosses 16. A wall of each chamber includes air holes 17*a* to enable the air to pass through one side of the wall.

The noise absorption chambers 17 are respectively filled with a first noise absorption material 18 in order to absorb the noise generated by inflowing air and the first noise absorption material 18 is mounted beneath a fixing plate 19. A fastening means 20 such as screws and the like pass through holes in the material 18 and plate 19 to fix the same to the bosses 16.

Meanwhile, the floor plate 11 is formed with a pair of guide grooves 11*a* at an approximate center thereof, and the guide grooves 11 *a* support a connecting pipe 21 therewithin for rotation within a predetermined angle. The connecting pipe 21 forms an air/dust outlet and a hollow connector 21*b* which is attachable to the hose 6, so that the dust and the air drawn from the suction in let 13 can be guided to the dust collector 3.

The connecting pipe 21 is at one side thereof formed with an opening 21*a* through which the dust and the air sucked into the suction entrance 13 can pass, and on both ends thereof, as illustrated in FIG. 6, there is integrally provided a noise absorption plate 22 formed with a plurality of noise absorption holes 22*a* which taper outwardly in diameter in a direction away from the opening 21*a* (see FIG. 7) to conduct air and noise.

Each noise absorption plate 22 is formed with a hinge shaft 23 at a central area thereof, and the shafts sits in a guide groove 11 *a*.

Furthermore, a second noise absorption material 24 is disposed at an outward side of the noise absorption plate 22 in order to reduce the noise generated by turbulent air flowing through the openings 21*a*, and a closure member 25 is closely inserted outwardly of the second noise absorption material 24 to prevent escape thereof.

Meanwhile, a third noise absorption material 26 is mounted on a bottom surface of the lid plate 12 in order to attenuate noise in the suction mouth piece body 10, and the third noise absorption material 26 is retained by a fixing plate 27 formed with a plurality of noise absorption holes 27*a*. A fastening means 20*a* such as screws and the like secure the plate 27 to the lid plate 12.

It should be noted that the first, second and third noise absorption materials 18, 24 and 26 are preferably made of porous materials such as sponge, fiber glass and the like.

Now, the operation of the vacuum cleaner thus constructed according to the present invention will be described.

First of all, when strong suction force generated by the operation of the driving means (not shown) acts in the suction mouth piece body 10, the cleaning operation is performed on the floor surface by way of movement of the body 10.

The foreign objects such as the dust and/or the like gathered by to a surface of the brush roller 14 are detached therefrom and sucked into the opening 21*a* of the connecting pipe 21, thereby causing the cleaning job to be conducted.

At this time, the air sucked into the connecting pipe 21 from the suction entrance 13 is caused to generate noise according as the diameter of the pipe tapers off, and the waves are propagated in various directions in the suction mouth piece body 10 to thereby be reduced in intensity.

In other words, sound waves generated at an entrance side of the connecting pipe 21 flow into the first noise absorption material 18 through holes 17*a* formed at one side of the noise absorption chamber 17 to thereby be dampened, and the noise sound waves travel upwardly from the entrance 13 travel through the noise absorption holes 27*a* and into the third noise absorption material to thereby be absorbed.

The noise generated in the course of the air being sucked into the connecting pipe 21 flows into the second noise absorption material 24 the noise absorption holes 22*a* to thereby be reduced in volume for minimized generation of the noise.

Furthermore, the noise generated from the driving means for generating the suction force travels into the connecting pipe 21 and the suction mouth piece body 10 and is dampened by the first, second and the third noise absorption materials for a still quieter cleaning job.

The noise absorption holes 22*a* formed in the noise absorption plate 22 facilitate a smooth reduction of the noise because the holes 22*a* are formed to taper off in toward the second noise absorption material 24.

As seen from the foregoing, the vacuum cleaner according to the present invention can achieve various noise reduction effects by eliminating the noise generated from the driving means and generated during absorption of the air by way of the first, second and third noise absorption materials formed on the upper and lower sides and both sides of the connecting pipe, thereby minimizing the generation of the noise and enabling a cleaning job to be done in a quiet and silent atmosphere.

The foregoing description of the preferred embodiment has been presented for the purpose of illustration and description. It is not intended to limit the scope of this invention. Many modifications and variations are possible in light of the above teachings. It should be noted that the present invention can be applied to all kinds of apparatuses within the scope of the above presentation.

What is claimed is:

1. A suction head for use with a suction generator of a vacuum cleaner, comprising:

a housing having an air/dust inlet formed in a lower surface thereof, and an air/dust outlet disposed behind said inlet, said inlet and outlet communicating with an interior of said housing, said inlet being situated forwardly of said connector and elongated transversely with respect to a direction of air flow therethrough, said inlet including opposite transverse ends, said outlet disposed behind a center region of said inlet;

a hollow connector communicating with said outlet and attachable to a hose for transmitting suction from the suction generator to said inlet; and noise dampening material arranged in said housing for dampening noise, said noise dampening material comprising a first material situated behind respective ones of said opposite ends of said inlet and on opposite transverse sides of said outlet.

2. The suction head according to claim 1, wherein a connector pipe is disposed in said housing, said connector pipe including a front portion forming said outlet, a rear portion forming said hollow connector, and a pair of opposite transverse sides mounted for rotation about an axis extending transversely relative to a direction of airflow through said hollow connector.

3. The suction head according to claim 2, wherein said noise dampening material further comprises a second material disposed adjacent said opposite transverse sides of said connector pipe.

4. The suction head according to claim 3, including a plate disposed at each of said opposite transverse sides of said connector pipe, said second material disposed outwardly of respective ones of said plates, said plates including through-holes communicating said outlet with said second material.

5. The suction head according to claim 4, wherein said through-holes taper in a direction toward said second material.

6. The suction head according to claim 3, wherein said connector pipe includes shafts projecting from said opposite transverse sides thereof, said second material comprising hollow cylinders extending coaxially around respective ones of said shafts.

7. The suction head according to claim 3, wherein said housing includes an upper wall, a front portion of which overlies said inlet, said noise dampening material including a third material disposed on an underside of said front portion of said upper wall.

8. The suction head according to claim 1, further including a connector pipe disposed in said housing, said connector pipe including a front end forming said outlet, a rear end forming said hollow connector, and a pair of opposite transverse sides mounted for rotation about an axis extending transversely relative to a direction of air flow through said hollow connector.

9. The suction head according to claim 8, wherein said noise dampening material is disposed adjacent said opposite transverse sides of said connector pipe.

10. The suction head according to claim 9, including a plate disposed at each of said opposite transverse sides of said connector pipe, said noise dampening material disposed outwardly of respective ones of said plates, said plates including through-holes communicating said outlet with said noise dampening material.

11. The suction head according to claim 10, wherein said through-holes taper in a direction toward said noise dampening material.

12. The suction head according to claim 11, wherein said connector pipe includes shafts projecting from said opposite transverse sides thereof, said noise dampening material comprising hollow cylinders extending coaxially around respective ones of said shafts.

13. The suction head according to claim 1, wherein said housing includes an upper wall, a front portion of said upper wall overlying said inlet, said noise dampening material disposed on an underside of said front portion of said upper wall.

14. The suction head according to claim 1, wherein said noise dampening material is disposed over said inlet in spaced relationship thereto, and on opposite transverse sides of said outlet.

15. A vacuum cleaner comprising:

a suction generator and dust collector;

a hose extending from said dust collector; and a suction head attached to a free end of said hose and comprising:

a housing having an air/dust inlet formed in a lower surface thereof, and an air/dust outlet disposed behind a center region of said inlet, said inlet and outlet communicating with an interior of said housing;

a hollow connector communicating with said outlet and attachable to said hose for transmitting suction from said suction generator to said inlet; and noise dampening material arranged in said housing for dampening noise, wherein at least some of said noise dampening material is located adjacent opposite transverse sides of said outlet.

16. The vacuum cleaner according to claim 15, wherein there is additional noise dampening material mounted on an underside of an upper wall of said housing in overlying relationship to said inlet.

17. The vacuum cleaner according to claim 15, wherein said noise dampening material is mounted on an underside of an upper wall of said housing in overlying relationship to said inlet.

* * * * *